United States Patent [19]

Bland

[11] 4,189,395

[45] Feb. 19, 1980

[54] CLEANSING PAD AND METHOD OF MAKING THE SAME

[75] Inventor: Frederick H. Bland, Grant Township, Washington County, Minn.

[73] Assignee: Minnesota Mining and Manufacturing Company, Saint Paul, Minn.

[21] Appl. No.: 870,021

[22] Filed: Jan. 19, 1978

[51] Int. Cl.[2] ..... C11D 17/04; C02B 1/44

[52] U.S. Cl. ..... 252/91; 15/104.93; 51/295; 51/298; 252/117; 252/120

[58] Field of Search ..... 51/298, 295, 296, 294; 252/90, 91, DIG. 1, 119, 117, 130, 131, 120; 15/104.93

[56] References Cited

U.S. PATENT DOCUMENTS

| | | | |
|---|---|---|---|
| 2,896,242 | 7/1959 | Winch | 252/91 |
| 3,177,055 | 4/1965 | Ruckle et al. | 51/295 |
| 3,261,675 | 7/1966 | Cameron | 51/295 |
| 3,897,356 | 7/1975 | Pociluyko | 252/91 |
| 3,954,642 | 5/1976 | Schwuger | 252/91 |
| 4,064,061 | 12/1977 | Henry | 252/119 |
| 4,078,340 | 3/1978 | Klecker et al. | 51/295 |
| 4,124,518 | 11/1978 | Stone et al. | 15/104.93 |

FOREIGN PATENT DOCUMENTS 1522759 8/1978 United Kingdom .

*Primary Examiner*—Donald J. Arnold
*Attorney, Agent, or Firm*—Cruzan Alexander; Donald M. Sell; Richard Francis

[57] ABSTRACT

A cleansing pad, which slowly releases its surfactant loading in use over an extended period of time, comprises a pad impregnated with a composition comprising a water-insoluble cured acrylic resin having grease-cutting, suds-forming nonionic surfactant blended therein. The cleansing pad is made by mixing the acrylic resin as a latex, a hydroxy-terminated stabilizing solvent such as ethylene glycol monoethyl ether, and nonionic surfactant, impregnating the pad with the mixture, and drying the pad.

11 Claims, No Drawings

CLEANSING PAD AND METHOD OF MAKING THE SAME

BACKGROUND OF THE INVENTION

1. Field of the Invention

This invention relates to an improved surfactant-impregnated cleansing pad and to a method of making the same.

2. Prior Art

Soap-containing cleansing and/or scouring pads are widely used to clean kitchen utensils, kitchen counters, automobiles and any of a wide variety of other soiled surfaces. One popular cleansing pad, sold under the trade designation "SOS" scouring pad, is formed of steel wool impregnated with a soap composition. Such a pad is undesirable for many users because, besides being formed of a material which will rust upon exposure to moisture, it rapidly loses its soap loading after a few short uses or a single extended use.

Attempts have been made to extend the surfactant use life of a cleansing pad by employing a binder material to retard the dissolution of surfactant. Poor results have been obtained with thermosetting or crosslinkable resins such as polyurethane, epoxide resin, phenolic resin, and the like, because they generally cure to a water-insoluble composition from which the soap or detergent is not easily extracted. Water-swellable or water-soluble binder materials such as hydrophilic proteinaceous agglutinates (e.g., gelatin or casein) were employed with limited success to retard the dissolution of anionic and/or nonionic surfactant, as disclosed in assignee's U.S. Pat. No. 3,788,999. U.S. Pat. No. 3,177,055 describes a cleaning pad impregnated with a butyl rubber binder formed from a latex and a detergent, preferably anionic, to obtain a long-life pad. While these cleansing pads have a moderately extended cleansing life due to the presence of a binder material, they have been found to be generally unsatisfactory by most consumers.

SUMMARY OF THE INVENTION

The present invention provides a cleansing pad which has a significantly prolonged useful sudsing life. The cleansing pad of the invention comprises a porous pad which is impregnated with a coatable composition comprising acrylic latex containing a hydroxy-terminated stabilizing solvent such as ethylene glycol monoethyl ether, and grease-cutting, suds-forming nonionic surfactant. Preferably the coating composition also contains a nonionic surfactant fatty acid ethanolamide (hereinafter referred to as "super-amide") foam stabilizer. The pad of the invention, once impregnated and dried, will contain nonionic surfactant blended in a water-insoluble cured acrylic resin to provide a weight ratio of resin to surfactant of about 3:1 to about 1:8, preferably 2:1 to 1:3.

The use of nonionic surfactants in cleansing pads has been generally avoided because of the low foaming character of these materials. It has however, been found, quite unexpectedly, that the incorporation of significant quantities of nonionic surfactant into acrylic resin pursuant to the present invention has produced a unique and useful product. Applicant has discovered sufficient nonionic surfactant can be incorporated into cured acrylic resin made from latex if a hydroxy-terminated stabilizing solvent is employed. The solvent permits the incorporation of relatively large amounts of nonionic surfactant without adversely affecting the coatability of the mixture or its ability to cure as a coherent film. Without the solvent, addition of significant amounts of nonionic surfactant to acrylic latex causes coagulation or undesirable gelling which produces a mass which is impossible to coat on or impregnate into a cleansing pad.

The nonionic surfactants incorporated in acrylic resin contained in the cleansing pads of the invention have been found to clean, even the greasiest kitchen utensils, providing quite adequate grease-cutting and foaming during cleaning. Additionally, the nonionic surfactant loading of the pads lasts for a considerably longer time than a similar loading of more commonly used anionic surfactant. The cleansing pads of the invention have also been found, quite surprisingly, to have a useful suds life of much longer than the longest suds life pad of the prior art described above, based upon unit weight of surfactant loading.

DETAILED DESCRIPTION OF THE INVENTION

The liquid coating or impregnating composition employed to make the cleansing pads of the invention comprises acrylic resin latex, hydroxy-terminated stabilizing solvent, and foaming and grease-cutting nonionic surfactant. The acrylic resin latex is of the type which will cure upon drying, usually at an elevated temperature, to water-insoluble composition from which the surfactant can be slowly leached or extracted. The acrylic latex typically is as an aqueous composition comprising at least about 35% solids and a resin particle size which is on the order of about 0.1 to 0.5 microns. The latex generally includes a small amount (e.g., 2–3 weight percent) of an emulsification surfactant, typically a nonionic or anionic surfactant. The pH of the latex typically is slightly acidic and may vary from about 3 to about 9. The acrylic resin may be of the non-crosslinking or the crosslinking type. Suitable commercially available acrylic latexes include those sold under the trade designation "Rhoplex" by the Rohm & Haas Company, particularly "Rhoplex" HA-8, "Rhoplex" RA-90, "Rhoplex" TR-407, -440, -485, and -653, and "Hycar" H2671 available from the B. F. Goodrich Company. The preferred acrylic resin latex is "Rhoplex" B-15.

The hydroxy-terminated stabilizing solvent is an alcohol which is liquid at room temperature and contained in the impregnating or coating composition to stabilize the latex to permit the addition of sufficient nonionic surfactant while preventing gelling, coagulation or other modification of the coating composition which would interfere with its coatability. Preferably, the hydroxy-terminated stabilizing solvent volatilizes at the curing temperature of the acrylic latex resin, or at a lower temperature. The preferred hydroxy-terminated stabilizing solvent is ethylene glycol monoethyl ether (sold under the trade designation ethyl "Cellosolve"). Other useful stabilizing solvents include methyl alcohol, ethyl alcohol, ethylene glycol monomethyl ether (sold under the trade designation methyl "Cellosolve"), ethylene glycol monobutyl ether (sold under the trade designation butyl "Cellosolve") and diethylene glycol monoethyl ether (sold under the trade designation ethyl "Carbitol").

The amount of stabilizing solvent used in a coating composition may vary depending upon the ingredients used. Functionally, the amount will be just sufficient to provide homogeneous blending of the latex with the nonionic surfactant without undesirable gelling or coagulation. The levels of stabilizing solvent in the coating composition will generally vary from about 5% to about 35% of the total weight of the liquid coating composition. More commonly, the level of stabilizing solvent will be from about 5% to about 25% by weight of the total weight of the liquid coating composition. Increasing amounts of stabilizing solvent are generally required with increasing amounts of nonionic surfactant to provide a homogeneous coatable liquid composition. Some minor experimentation may be required to determine the exact amount of solvent required since there may be some variation in the amount required depending upon the type of nonionic surfactant employed. Such experimentation will be well within the capability of one skilled in the art, once being apprised of the present disclosure.

Any one of a wide variety of nonionic surfactants will be suitable for use in the present invention, provided the selected nonionic surfactant or surfactants will not cause undesirable gelling or coagulation or other modification of the acrylic latex resin to interfere with its coatability. A limited amount of gelling can be tolerated to provide a suitable coatable composition, but coagulation cannot. Gelling occurring in the liquid composition after 48 hours can be tolerated. Substantial gelling which occurs within 48 hours is considered undesirable with present production techniques. Faster gelling may be tolerated with more rapid production techniques.

The viscosity of the coating or impregnating composition typically will vary between 50 to 20,000 centipoise, preferably 50 to 1,000 centipoise, to obtain adequate coating and impregnation.

The nonionic surfactant (or surfactants) employed in the cleansing pad of the invention should have grease-cutting and suds-forming capability. The nonionic surfactant may be a single surfactant providing both of these functions or it may be a mixture of nonionic surfactants providing enhanced suds-forming and grease-cutting. Other nonionic surfactants may also be employed to further improve the performance of the product. For example, a super-amide, commonly employed as a foam stabilizer, may also be included. It should be noted that applicant has discovered that the super-amide may be employed as the only nonionic surfactant in the coating or impregnating composition of the cleansing pad of the invention. A pad so impregnated or coated will have adequate sudsing and grease-cutting ability and such a pad is intended to be within the scope of the present invention. The super-amide also may be added with other nonionic surfactants to provide its commonly known function, foam stabilization.

The nonionic surfactant content of the liquid coating or impregnating composition is sufficient to obtain the aforementioned weight ratio of acrylic resin to surfactant in the final product.

Ethoxylated nonionic surfactants have been found to be particularly useful in the present invention. Mixtures of ethoxylated nonionic surfactants have been found to provide the best performance. It has been found that ethoxylated nonionic surfactants having 35% to 45% ethoxylation provide superior grease-cutting ability while ethoxylated nonionic surfactants having 45% to 90% ethoxylation provide superior sudsing ability. Suitable mixtures of ethoxylated nonionic surfactants have been found to be provided by combinations of such surfactants which provide a weight ratio of the ethoxylated nonionic surfactant having 35% to 45% ethoxylation to the ethoxylated nonionic surfactant having 45% to 90% ethoxylation on the order of 1:2 to 4:1.

Suitable commercially available ethoxylated nonionic surfactants useful in the present invention include octyl phenoxy polyethoxy ethanol having from 5 to 40 moles of ethylene oxide and sold under the trade designation "Triton", including "Triton" X100, X35, X45, X165, X305 and X405, nonyl phenoxy polyethoxy ethanol sold under the trade designation "Triton" N101, polyethylene glycol ethers of linear alcohols having from 3 to 20 moles of ethylene oxide and sold under the trade designation "Tergitol" such as "Tergitol" 15S5, 15S7, 15S9, 15S12 and 15S20, polyethylene oxide blocked polypropylene oxide sold under the trade designation "Pluronic" L35, ethoxylated sorbitan monolaurate sold under the trade designation "Tween" 21, and ethoxylated primary fatty alcohol sold under the trade designation "Alfonic" 1012-60.

The amount of super-amide contained in the coating or impregnating composition, on a weight basis, based on the total weight of nonionic surfactant, typically is on the order of 5% to 100%. When the nonionic surfactant comprises ethoxylated nonionic surfactant and super-amide, the amount of super-amide will generally vary from 5% to 25% by weight of the total nonionic surfactant, with the balance being ethoxylated nonionic surfactant.

Commercially available useful super-amides include lauric diethanolamide sold under the trade designation "Richamide" STD, coconut diethanolamide sold under the trade designation "Richamide" M3, lauric-myristic alkanolamide sold under the trade designation "Monamid" 150LMW-C, lauric monoethanolamide sold under the trade designation "Monamid" LMA, coconut diethanolamide sold under the trade designation "Ninol" 128 Extra, cocodiethanolamide sold under the trade designation "Calamide" C. The preferred super-amide is lauric diethanolamide sold under the trade designation "Richamide" STD.

In some cases, it may be necessary to adjust the pH of the coating composition, preferably to that of the latex used, by addition of acid or base to prevent excessive thickening and permit curing of the acrylic resin latex. For example, the acrylic resin latex sold under the trade designation "Rhoplex" B-15 thickens excessively and is difficult to cure because of the increased pH resulting from the addition of super-amide to the composition. The pH should be lowered in this case by the addition of an acidic compound such as acetic acid. The amount of acetic acid required in this case is about 3 to 4 parts glacial acetic acid per 100 parts super-amide.

The pad into which the liquid impregnating or coating composition described above is incorporated may be any one of a number of pads known for this use. Useful pads include natural or synthetic sponges, steel wool pads, paper toweling, woven cloth pads, pads formed of narrow aluminum, bronze or plastic fibers or ribbons, nonwoven fabric of varying density, porosity and thickness, nonwoven, lofty, low-density abrasive scouring pads of the type for example described in the Hoover et al Patent (U.S. Pat. No. 2,958,593) and composite structures incorporating one or more of the foregoing as elements.

The pad may be of any convenient size for use in cleaning. Typical sizes will be such to permit holding in the hand of the user. Some applications require larger sizes and irregular shapes, depending upon the particular application. For example, the pads may be of a shape and size to be employed in cleaning machines, e.g., those which use a rotary pad.

The coating or impregnating composition loading will vary, depending upon the type of pad employed, its thickness, its porosity and the intended use of the resultant cleansing pad. It has been found, for household use (for example for cleaning kitchen implements), an adequate loading is provided by 200 to 650 grams per square meter (dry weight) for a ¼ inch thick pad of nonwoven, lofty, low-density abrasive product. The particular loading may easily be determined by minor experimentation, this being well within the skill of the art.

The liquid coating or impregnating composition described above may be coated or impregnated into the pad by any one of a number of known methods. For example, the coating or impregnating composition may be applied by roll coating, by immersion coating, by spray coating or by a combination of these coating techniques. Once coated, the pad is dried, preferably by heating to expel the solvents and effect curing of the acrylic latex resin. Heating at temperatures in the range of about 200° to 350° F. for 5 to 30 minutes has been found to effect complete evaporation and curing. The curing time will of course vary directly with the curing temperature, longer times being needed for lower curing temperatures. Curing conditions will also have to take into account the composition of the pad, some pads being more susceptible to damage or destruction by heat than others. Heating may be accomplished by use of forced air ovens or by other means such as microwave or radio frequency heating.

Other ingredients may be incorporated into the coating or impregnating composition to provide modifications in the cleansing pad of the invention. For example, colorants, odorants, disinfectants and particulate abrasive material may be included, preferably in minor amounts, typically up to 10%. The abrasive material may be included in larger amounts, e.g., up to 75% of the total weight of the dried composition. Additionally, it has been found that the addition of minor amounts, typically less than 5% by weight of the total dry composition, of thermosetting resins such as urea-formaldehyde resin, melamine-formaldehyde resin and phenol-formaldehyde resin further increases the suds life of the surfactant in the cleansing pads of the invention. Excessive amounts of such thermosetting resin should be avoided, e.g., amounts in excess of 25% by weight, because such excessive amounts will adversely affect the dissolution of the surfactant and provide an undesirable product.

TEST PROCEDURE

The pads of the invention were evaluated to determine their useful sudsing life by a wringer test involving the use of a pair of 10 inch long 2 inch diameter nip rolls spring biased together and driven by an air motor. A test sample 75 millimeters by 100 millimeters of each pad was evaluated. The dry weight of the pad was recorded before and after the test to determine the amount of material extracted during the test. The test involved immersing the test pad in 100° F. tap water and passing the pad three times through the nip rolls, rinsing the nip with the tap water and repeating these steps until no suds are produced at the nip roll as the pad is passed therethrough. Each immersion and triple pass through the nip is considered one cycle for purposes of reporting.

A second test involving the use of grease, to determine the grease cutting ability of the pad, involved the use of the same equipment, except a metal plate coated with a film approximately 0.025 inch thick of lard containing red dye is also employed. Approximately 4 square inches of the grease-coated plate surface is scrubbed with the test pad after every fifth wringer cycle, as long as the lard is visibly emulsified, and otherwise following the procedure described above.

The tap water employed was that provided by the City of Saint Paul, Minnesota Water Department. This water is relatively hard, having a total hardness of 79 to 107 milligrams per liter as calcium carbonate. Wringer test results with softer water will be expected to produce higher results (more cycles).

Wringer test results reported in the following examples are without the use of grease, unless otherwise specified therein.

EXAMPLES

The invention is further illustrated by the following Examples wherein all parts are by weight, unless otherwise specified.

EXAMPLE 1

Surfactant Coating Composition

A coating composition was prepared of the following ingredients:

| Ingredients | Parts by Weight |
|---|---|
| acrylic latex resin 46% solids (sold under the trade designation "Rhoplex" B-15) | 54.5 |
| ethylene glycol monoethyl ether (sold under the trade designation ethyl "Cellosolve") | 18.2 |
| octyl phenoxy polyethoxyethanol surfactant containing 5 moles ethylene oxide (sold under the trade designation "Triton" X45) | 9.1 |
| octyl phenoxy polyethoxyethanol surfactant containing 16 moles ethylene oxide (sold under the trade designation "Triton" X165 (70% active) | 4.5 |
| lauric diethanolamide (a super-amide sold under the trade designation "Richamide" STD) containing 3–4 parts acetic acid per 100 parts amide | 13.6 |

The ethylene glycol monoethyl ether (ethyl "Cellosolve") was added to the acrylic latex to stabilize the latex prior to addition of the nonionic surfactants. The ethyl "Cellosolve" and acrylic resin latex were added with moderate stirring at room temperature to produce a homogeneous mixture. Thereafter, the remaining ingredients were added with moderate stirring at room temperature to provide a coatable homogeneous blend having a 51% solids.

Pad

A pad was prepared by first forming a web of 1½ inch long, 15 denier crimped polyethylene terephthalate staple fibers having about 10 to 15 crimps per inch, using a "Rando Webber" web-forming machine to produce a web approximately 10 to 12 millimeters thick having a weight of 109 grams per square meter.

| Ingredients | Parts by Weight |
|---|---|
| Pad Roll Coating Composition (10% Solids) | |
| thermosetting phenol-formaldehyde resin (75% solids in a mixture of 30% by weight ethyl "Cellosolve" and 70% by weight water) | 13.3 |
| isopropanol | 8.7 |
| tap water | 78 |
| Pad Spray Coating Composition (71% Solids) | |
| thermosetting phenol-formaldehyde resin (75% solids in a mixture of 30% by weight ethyl "Cellosolve" and 70% by weight water) | 10.6 |
| isopropanol | 2.3 |
| tap water | 20.3 |
| abrasive granules (ground silica passing through 300 mesh screen) | 49.0 |
| calcium carbonate filler (7-50 microns in average diameter) | 10.6 |
| colorant dispersion (54% solids in ethyl "Cellosolve") | 7.3 |

The formed web was roll coated with the roll coating composition described above to provide a wet coating weight of 84 grams per square meter (dry add on weight of 8.4 grams per square meter). The resultant coated web was then spray coated on one side with the spray coating composition described above to provide a wet add on weight of 130 grams per square meter (dry add on weight of 92 grams per square meter). The resultant coated web was then cured in a forced air oven heated at 280° to 300° F. with a residence time therein of 5 minutes. The opposite side of the web was then spray coated with the spray coating composition to provide a wet add on weight of 130 grams per square meter. This coating was then cured in a forced air oven heated at 300° to 330° F. with a residence time therein of 5 minutes.

The cured abrasive web, having a thickness of approximately 7-10 millimeters, was roll coated with the surfactant coating composition described above to provide a wet add on weight of 510 grams per square meter segment (260 grams per square meter segment dry weight). The resultant saturated web was dried in a forced air oven heated to 240° to 275° F. with a residence time therein of 5 minutes.

The resultant cleansing pad, when tested with the wringer test described above, required 173 cycles to extract the surfactant.

EXAMPLE 2

A cleansing pad was prepared by impregnating the pad described in Example 1 with a composition comprised of the following ingredients:

| Ingredients | Parts by Weight |
|---|---|
| acrylic resin latex sold under the trade designation "Rhoplex" B-15 | 53 |
| nonionic surfactant sold under the trade designation "Triton" X45 | 21 |
| nonionic surfactant sold under the trade designation "Triton" X405 | 10.5 |
| coco diethanolamide | 6.0 |
| solvent sold under the trade designation butyl "Cellosolve" | 8.0 |
| acetic acid | 0.3 |

The ingredients, except for the acrylic resin latex, were blended together and then added with stirring to the acrylic resin latex to form a coatable composition. The coatable composition was coated, employing the procedures described in Example 1, to coat a pad of the type described in Example 1 to produce a cleansing pad having a dry coating weight of this composition of approximately 530 grams per square meter. The resultant cleansing pad, when tested in the wringer test described above, required 154 cycles to exhaust the surfactant. When tested with the wringer test including grease, the surfactant was exhausted after 95 cycles.

EXAMPLE 3

A cleansing pad incorporating ethoxylated primary alcohol nonionic surfactant was prepared by using a coating composition comprised of the following ingredients:

| Ingredients | Parts by Weight |
|---|---|
| ethoxylated primary alcohol surfactant sold under the trade designation "Alfonic" 1012-60 | 100 |
| coco diethanolamide | 20 |
| solvent sold under the trade designation butyl "Cellosolve" | 10 |
| acetic acid | 1 |
| acrylic resin latex sold under the trade designation "Rhoplex" B-15 | 100 |

All of the ingredients, except for the latex, were mixed together at room temperature and then added to the latex with continued stirring. The resultant coatable composition was employed to impregnate a pad of the type described in Example 1, to provide a cleansing pad having a dry add on weight of 530 grams per square meter.

When evaluated employing the wringer test described above, the surfactant was exhausted after 52 cycles.

EXAMPLE 4

A cleansing pad including ethoxylated secondary alcohol was prepared of the following ingredients:

| Ingredients | Parts by Weight |
|---|---|
| nonionic surfactant sold under the trade designation "Tergitol" 15S15 | 50 |
| nonionic surfactant sold under the trade designation "Tergitol" 15S5 | 50 |
| coco diethanolamide | 20 |
| solvent sold under the trade designation butyl "Cellosolve" | 10 |
| acetic acid | 1 |
| acrylic resin latex sold under the trade designation "Rhoplex" B-15 | 100 |

The ingredients, except for the latex, were mixed together and added to the latex with stirring at room temperature, coated on a pad of the type described in Example 1, and dried. The dry add on weight was 530 grams per square meter. The wringer test required 65 cycles to remove the surfactant.

EXAMPLE 5

A cleansing pad embodying ethoxylated octophenol nonionic surfactant was prepared of the following ingredients:

| Ingredients | Parts by Weight |
|---|---|
| nonionic surfactant sold under the trade designation "Triton" X45 | 100 |
| coco diethanolamide | 20 |
| solvent sold under the trade designation butyl "Cellosolve" | 10 |
| acetic acid | 1 |
| acrylic resin latex sold under the trade designation "Rhoplex" B-15 | 100 |

The ingredients were mixed and coated upon a pad following the procedure of Example 4 to produce a cleansing pad having a dry add on weight of 530 grams per square meter and requiring 35 cycles on the wringer test to remove the surfactant.

EXAMPLE 6

A cleansing pad including ethylene oxide blocked polypropylene oxide nonionic surfactant was prepared of the following ingredients:

| Ingredients | Parts by Weight |
|---|---|
| nonionic surfactant sold under the trade designation "Pluronic" P85 | 100 |
| coco diethanolamide | 20 |
| solvent sold under the trade designation butyl "Cellosolve" | 10 |
| acetic acid | 1 |
| acrylic resin latex sold under the trade designation "Rhoplex" B-15 | 100 |

The ingredients, except for the latex, were blended together and then added to the latex with stirring. The resultant mixture was employed to coat a pad of the type described in Example 1 following the procedures described in Example 1 to produce a pad having a dry add on weight of 530 grams per square meter. When evaluated with the wringer test described above, the pad required 52 cycles for removal of the surfactant.

EXAMPLE 7

A cleansing pad according to the invention was prepared by blending equal parts of acrylic resin latex sold under the trade designation "Rhoplex" B-15 with an ethyleneoxide blocked polypropylene oxide nonionic surfactant sold under the trade designation "Pluronic" P85 and coating this mixture on a web of the type described in Example 1. The coated web was then cured following the procedures described in Example 1 and evaluated on the wringer test described above. The pad required 50 cycles to remove the surfactant, losing 2.1 grams of surfactant during this time, or approximately 24 cycles per gram.

To establish the superiority of products containing the acrylic resin according to the present invention, the same surfactant was coated without binder on a pad of the type described in Example 1. The surfactant is a solid at room temperature and it was first melted and then coated on the web to provide a dry coating weight of 1020 grams per meter. When tested using the wringer test described above, 27 cycles were required to remove the surfactant, removing approximately 8.2 grams of surfactant or 3 cycles per gram.

EXAMPLE 8

A cleansing pad according to the invention was made including a super-amide nonionic surfactant as the only surfactant in the composition of the following ingredients:

| Ingredients | Parts by Weight |
|---|---|
| acrylic resin latex sold under the trade designation "Rhoplex" B-15 | 60 |
| solvent sold under the trade designation ethyl "Cellosolve" | 20 |
| lauric diethanolamide nonionic surfactant sold under the trade designation "Richamide" STD | 15 |

The ingredients were mixed individually in the order shown with stirring to produce a coatable composition which was coated on a web of the type described in Example 1 following the procedures described in Example 1. The dry add on weight of the resultant cleansing pad was 250 grams per square meter. In the wringer test with grease described above, the pad required 25 cycles until no more suds appeared.

What is claimed is:

1. An improved cleansing pad of the type which has incorporated therein a surfactant cleansing material wherein the improvement comprises incorporating said surfactant cleansing material as a coating composition comprising: water-insoluble cured acrylic latex resin having suds-forming, grease-cutting nonionic surfactant blended therein to provide a 3:1 to 1:8 weight ratio of resin to nonionic surfactant.

2. The cleansing pad of claim 1 wherein said nonionic surfactant is a mixture of ethoxylated nonionic surfactant and super-amide.

3. The cleansing pad of claim 1 wherein said nonionic surfactant is a super-amide.

4. The cleansing pad of claim 1 wherein said nonionic surfactant is selected from the group consisting of octyl phenoxy polyethoxy ethanol having from 3 to 40 moles of ethylene oxide, polyethylene glycol ethers of linear alcohols having from 3 to 20 moles of ethylene oxide, polyethylene oxide blocked polypropylene oxide, ethoxylated sorbitan monolaurate, ethoxylated linear fatty acid alcohol, and mixtures thereof.

5. The cleansing pad of claim 2 wherein said ethoxylated nonionic surfactant is a mixture of ethoxylated nonionic surfactant having from 35% to 45% ethoxylation and ethoxylated nonionic surfactant having from 45% to 90% ethoxylation in a weight ratio of about 1:2 to 4:1.

6. The cleansing pad of claim 2 wherein said ethoxylated nonionic surfactant mixture comprises octyl phenoxy polyethoxy ethanol having 5 moles of ethylene oxide and octyl phenoxy polyethoxy ethanol having 16 moles of ethylene oxide.

7. The cleansing pad of claim 2 wherein said super-amide is selected from the group consisting of lauric diethanolamide, coconut diethanolamide, lauric-myristic alkonalamide, and lauric monoethanolamide.

8. The cleansing pad of claim 1 wherein said pad is a lofty, open, nonwoven abrasive pad formed of crimped synthetic fibers adhesively bonded together with a water-insoluble binder material which contains abrasive particles.

9. The cleansing pad of claim 1 wherein said pad comprises a sponge element.

10. A method of making a cleansing pad which slowly releases its surfactant loading over an extended period of time, comprising:

(1) preparing a liquid coatable composition comprising:

(a) acrylic resin latex;

(b) sufficient hydroxy-terminated stabilizing solvent to avoid coagulation or gelling within 48 hours;

(c) grease-cutting, suds-forming nonionic surfactant to provide a weight ratio of 3:1 to 1:8 of acrylic resin to nonionic surfactant;

(2) incorporating the resulting coatable composition into suitable porous cleansing pad; and (3) drying said incorporated coatable composition under conditions which substantially remove solvent and cure said acrylic resin.

11. The method of making a cleansing pad of claim 10 wherein the hydroxy-terminated stabilizing solvent is ethylene glycol monoethyl ether.

* * * * *